US006026555A

United States Patent [19]

Sager

[11] Patent Number: 6,026,555

[45] Date of Patent: Feb. 22, 2000

[54] COATED TUBE AND FITTING ASSEMBLY

[75] Inventor: Richard A. Sager, Lapeer, Mich.

[73] Assignee: Form Rite, Auburn Hills, Mich.

[21] Appl. No.: 08/856,539

[22] Filed: May 15, 1997

[51] Int. Cl.[7] ..... B21D 39/00

[52] U.S. Cl. ..... 29/458; 29/523

[58] Field of Search ..... 29/458, 525, 523; 285/334.5, 55, 382, 148.23, 374, 399, 915

[56] References Cited

U.S. PATENT DOCUMENTS

| | | | |
|---|---|---|---|
| 2,011,452 | 6/1935 | Lutz | 285/399 |
| 3,318,340 | 5/1967 | Torti | 138/140 |
| 3,461,523 | 8/1969 | Peehs et al. | 285/328 |
| 4,125,924 | 11/1978 | Goetze | 29/148.4 |
| 4,359,812 | 11/1982 | Haag et al. | 285/148.23 |
| 4,598,937 | 7/1986 | Sugao | 285/55 |
| 4,784,311 | 11/1988 | Sugao | 228/131 |
| 5,489,127 | 2/1996 | Anglin | 285/328 |
| 5,749,138 | 5/1998 | Usui et al. | 29/515 |

*Primary Examiner*—S. Thomas Hughes
*Assistant Examiner*—Steve Blount
*Attorney, Agent, or Firm*—Howard & Howard

[57] ABSTRACT

In a method for securing an end fitting to a coated tube, a tube having a standard outer diameter is coated with a non-corrosive material. The coated tube is then held in a clamp while an outer end of the tube is inserted into the opening of a reduction punch. The reduction punch is then forced axially towards the tube, reducing the outer diameter of the tube and coating to approximately the original outer diameter of the uncoated tube. As a result, a standard end fitting having an inner diameter generally equal to the uncoated tube outer diameter can be utilized on the reduced end of the coated tube. The end fitting is then secured to the reduced end of the coated tube in a known manner, such as by flaring.

6 Claims, 2 Drawing Sheets

COATED TUBE AND FITTING ASSEMBLY

BACKGROUND OF THE INVENTION

The present invention relates to a coated metal tubing and fitting assembly, and particularly to a method of securing a fitting to an end of a coated tube.

It is often desirable to coat steel tubes with nylon or other materials in order to provide corrosion resistance; however, this presents an additional problem. Although the coating may be only 0.005 or 0.006" thick, this increase in diameter is sufficient to prevent the use of standard end fittings with the coated tubes. One proposed solution has been to provide non-standard end fittings, which include a larger inner diameter to accommodate the thickness of the coating. However, the additional expense of tooling and producing limited production non-standard end fittings to be used only for coated tubes is undesirable. Similarly, it would be impractical to provide non-standard tube sizes which when coated would fit standard end fittings. Another proposed solution has been to remove the coating from the ends of the tube in order to accommodate the end fitting. However, removal of coating from the ends of the coated tube is also costly and impractical.

SUMMARY OF THE INVENTION

The present invention provides a coated tube and fitting assembly and a novel method for securing an end fitting to a coated tube. In the method according to the present invention, a metal tube of standard outer diameter is coated with a non-corrosive material, thereby increasing the outer diameter of the coated tube to a non-standard outer diameter. The end of the coated tube is then placed into a standard diameter reduction punch, which reduces the outer diameter of the coated tube to the original standard outer diameter of the tube. The end fitting, having a standard inner diameter generally equal to the standard outer diameter of the uncoated tube, is then secured to the outer end of the coated tube.

The present invention provides an inexpensive method for securing less expensive and commercially available end fittings with coated tubes. As a result, the coated tube and end fitting have corrosion resistance and lower cost due to the use of standard commercially available end fittings and tubes.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DETAILED DESCRIPTION OF A PREFERRED EMBODIMENT

Figure 1:
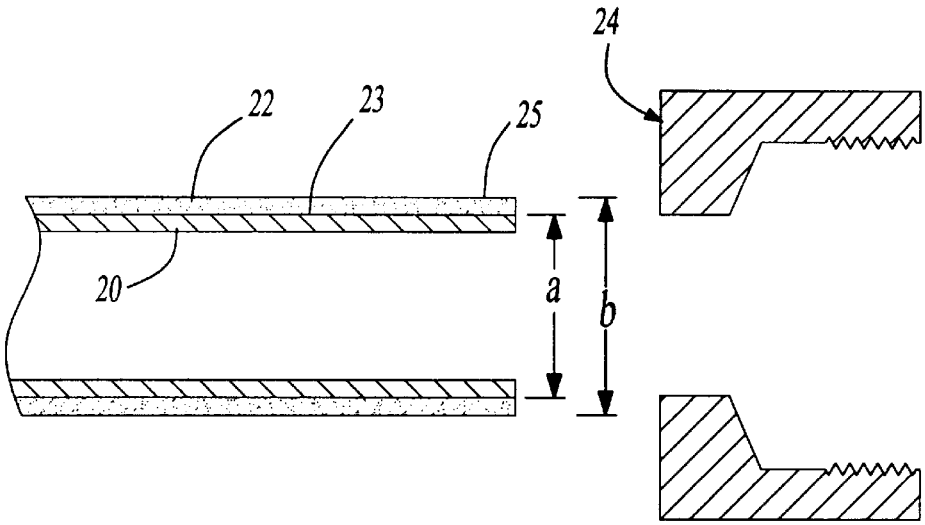
FIG. 1 is a sectional view of a coated tube and standard end fitting unassembled.

A metal tube 20 having a standard outer diameter a is coated with a corrosive resistant coating 22 on the outer surface 23 of the tube 20 as shown in FIG. 1. Preferably, the tube 20 is steel and the coating 22 is nylon 12. The total outer diameter of the tube 20 and coating 22 is diameter b. A standard fitting 24 has an inner diameter generally equal, or slightly greater than, the outer diameter a of the tube 20. Although the coating 22 is thin (approximately 0.010–0.015"), the outer diameter b at an outer end 25 of the tube 20 and coating 22 is too large to be inserted into the standard fitting 24.

Figure 2:
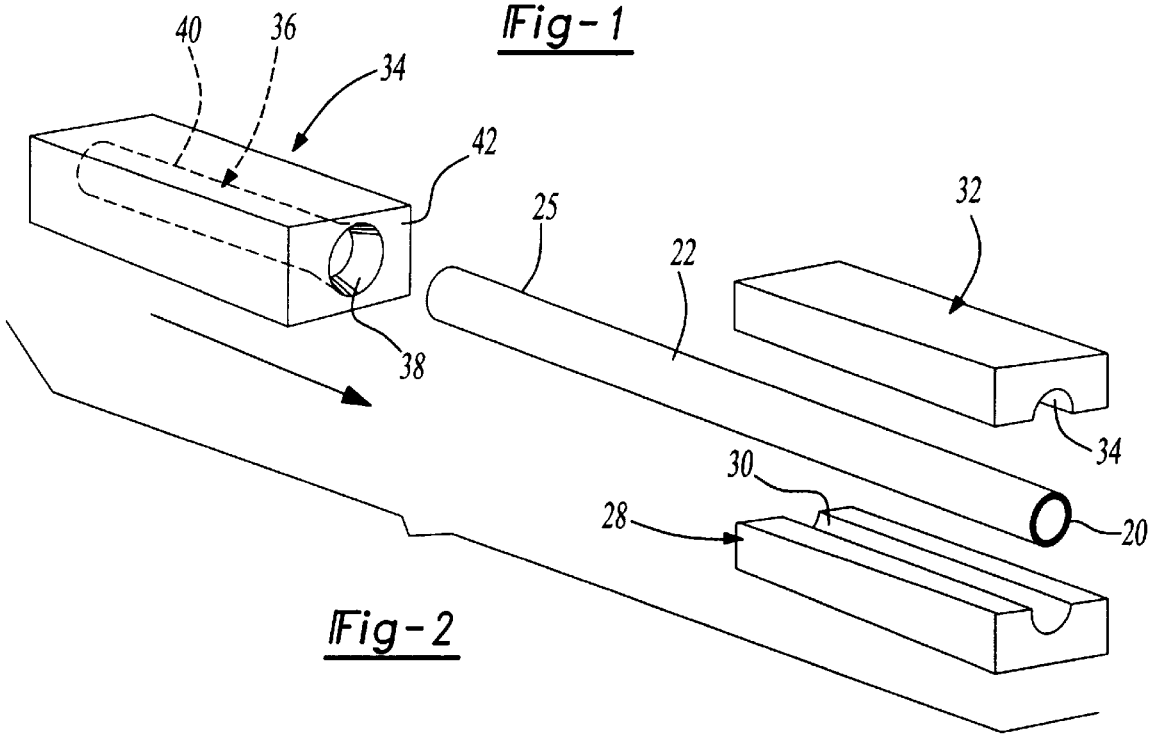
FIG. 2 is a perspective view of the coated tube of FIG. 1 and tooling for performing the method of the present invention.

As can be seen in FIG. 2, a lower clamp jaw 28 includes a groove 30 which is semi-circular in cross section and of a radius slightly less than half of the outer diameter b of the tube 20 with the coating 22. A complementary upper clamp jaw 32 includes a similar groove 34 having a semi-circular cross-section also of a radius slightly less than half the outer diameter b of the tube 20 with the coating 22. A reduction punch 35 includes an axial passage 36 leading from a first orifice 38 and a reduced portion 40. A tapered portion 42 is preferably disposed between the orifice 38 and the reduced portion 40.

Figure 3:
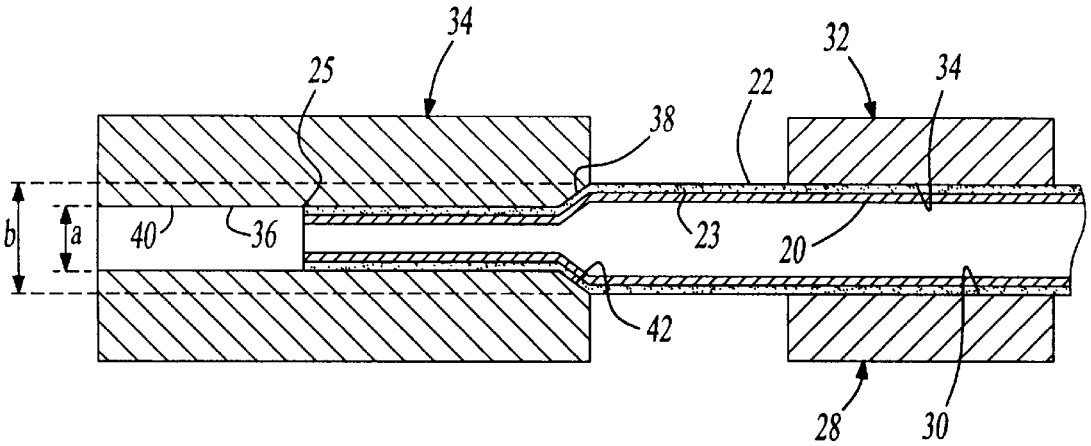
FIG. 3 is a sectional view of the coated tube and tooling of FIG. 2 in operation.

As can be seen in FIG. 3, the orifice 38 of the reduction punch 35 preferably has an inner diameter generally equal to or slightly greater than the diameter b of the tube 20 and coating 22. The reduced portion 40 of the axial passage 36 preferably has an inner diameter equal to the outer diameter a of the tube 20. The tapered portion 42 is disposed between the orifice 38 and the reduced portion 40. In a method according to the present invention, the metal tube 20 is preferably coated with the coating 22 in a manner well-known in the art. The coated tube 20, 22 is then held tightly between upper clamp jaw 32 and lower clamp jaw 28 in axial grooves 34, 30. The outer end 25 of the tube 20 and coating 22 is then inserted into the orifice 38 of the reduction punch 35. The reduction punch 34 is then driven axially towards the tube 20, causing the outer end 25 of the tube 20 and coating 22 to be forced into the reduced portion 40 of the axial passage 36. As a result, the outer diameter of the tube 20 and coating 22 is reduced generally to the inner diameter a of the reduced portion 40, which is the original outer diameter of the tube 20.

Figure 4:
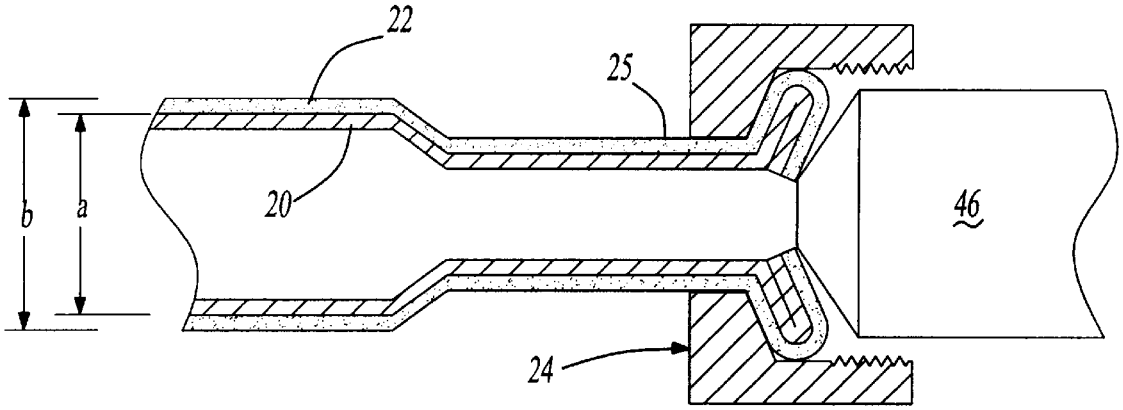
FIG. 4 is the coated tube with standard end fitting of the present invention.

As can be seen in FIG. 4, when the tube 20 with coating 22 is removed from the reduction punch 35, the outer end 25 of the tube 20 and coating 22 is generally equal to the original tube 20 diameter a, which is equal to or slightly less than the inner diameter of the end fitting 24. The outer end 25 of the tube 20 and coating 22 can then be inserted into the end fitting 24 and secured in a known matter, such as by flaring the end 25 with a flaring tool 46. Utilizing this inexpensive method, a tube 20 having a standard outer diameter a can receive a corrosive resistant coating 22 and be used with a standard end fitting 24 having a standard inner diameter a. Costs are greatly reduced because standard tubes 20 and standard end fittings 24 can be utilized, rather than limited-production tubes 20 or end fittings 24.

It should be apparent that the present invention could be utilized with any standard sized tubes 20 and end fittings 24. For example, for a 5/16th inch standard size tube 20, diameter a in the drawings would be 5/16 inch and diameter b would be approximately 0.324 inches.

In accordance with the provisions of the patent statutes, the present invention has been described in what is considered to represent a preferred embodiment. However, it should be noted that the invention can be practiced otherwise than as specifically illustrated and described without departing from its spirit or scope.

What is claimed is:

1. A method for securing an end fitting to a coated tube including the steps of:

a) coating an outer surface of a metal tube having an outer diameter equal to a first diameter with a non-corrosive coating, said coated tube having a second diameter greater than said first diameter;

b) deforming an end of said coated tube radially inward such that said outer diameter of said coated tube is generally equal to said first diameter;

c) inserting said end of said coated tube into a fitting having an inner diameter generally equal to said first diameter of said tube; and d) securing said fitting to said end of said coated tube.

2. The method according to claim 1, wherein step b) includes inserting said end of said tube into a reduction punch having an inner diameter generally equal to said second diameter and an axial passage including a reduced portion having an inner diameter generally equal to said first diameter.

3. The method according to claim 1, further including the step of flaring said end of said tube.

4. The method according to claim 1, wherein said step a) is performed before said step b) and said step b) is performed before said step c).

5. A method for securing an end fitting to a coated tube including the steps of:

a) coating an outer surface of a metal tube having an outer diameter generally equal to a first diameter with a non-corrosive coating, said coated tube having a second diameter greater than said first diameter;

b) inserting said end of said tube into a reduction punch having an opening having an inner diameter generally equal to said second diameter and an axial passage including a reduced portion having an inner diameter generally equal to said first diameter;

c) deforming an end of said coated tube radially inward such that said outer diameter of said coated tube is generally equal to said first diameter;

d) inserting said end of said coated tube into a fitting having an inner diameter generally equal to said first diameter of said tube; and e) securing said fitting to said end of said coated tube, wherein said step a) is performed before said step b) and said step b) is performed before said step d).

6. The method according to claim 5, further including the step of flaring said end of said tube.

* * * * *